United States Patent [19]

Bjurling

[11] 4,376,494

[45] Mar. 15, 1983

[54] INSULATED TANK CONTAINER

[75] Inventor: Anders Bjurling, Skultuna, Sweden

[73] Assignee: Dynatrans AB, Frolunda, Sweden

[21] Appl. No.: 224,561

[22] PCT Filed: Mar. 26, 1980

[86] PCT No.: PCT/SE80/00086

§ 371 Date: Nov. 26, 1980

§ 102(e) Date: Nov. 26, 1980

[87] PCT Pub. No.: WO80/02019

PCT Pub. Date: Oct. 2, 1980

[30] Foreign Application Priority Data

Mar. 28, 1979 [SE] Sweden ..... 79027629

[51] Int. Cl.[3] ..... B65D 90/04

[52] U.S. Cl. ..... 220/444; 206/523; 220/84; 220/401; 220/901; 220/902

[58] Field of Search ..... 220/401, 444, 901, 902, 220/1.5, 84; 206/516, 523

[56] References Cited

U.S. PATENT DOCUMENTS

| | | | |
|---|---|---|---|
| 695,618 | 3/1902 | Mack | 220/84 |
| 2,764,314 | 9/1956 | Mautner | 220/84 |
| 3,112,043 | 11/1963 | Tucker | 220/901 |
| 3,115,982 | 12/1963 | Morrison | 220/4 C X |
| 3,122,259 | 2/1964 | Meesen | 220/901 |
| 3,411,656 | 11/1968 | Jackson | 220/444 |
| 3,412,521 | 11/1968 | Ballman | 206/523 X |
| 3,435,946 | 4/1969 | Sobek et al. | 206/523 |
| 3,896,961 | 7/1975 | Guilhelm et al. | 220/901 |

FOREIGN PATENT DOCUMENTS

| | | | |
|---|---|---|---|
| 1071575 | 12/1959 | Fed. Rep. of Germany | 220/84 |
| 2856442 | 7/1980 | Fed. Rep. of Germany | 220/1.5 |
| 1294767 | 4/1962 | France | 220/84 |
| 1442399 | 7/1976 | United Kingdom | 220/901 |

*Primary Examiner*—Joseph M. Moy
*Assistant Examiner*—Gary E. Elkins
*Attorney, Agent, or Firm*—Laurence R. Brown

[57] ABSTRACT

The invention relates to an insulated tank container. In order to obtain a particularly light and cheap construction, the tank container consists of a thin inner shell (4) and outside this semi-hard or hard insulation (6, 8, 10, 11) which has the capacity to take up and transfer stresses in various directions and is firmly glued to the inner shell. An outer shell (5, 7, 9) with a framework (1) may be disposed outside the insulation. As an alternative, the insulation may be introduced, foamed and hardened in situ between preformed shells.

4 Claims, 6 Drawing Figures

INSULATED TANK CONTAINER

TECHNICAL FIELD

The present invention relates to an insulated tank container, preferably but not exclusively of the type which comprises a framework and which can be transferred between different vehicles etc.

PRIOR ART

Conventional insulated tank containers have such a thick inner body plate that this carries the stresses of the load and any internal excess pressure. In other words, the tank or container is self-supporting and the insulation situated on the outside (with a protective outer skin) has, in principle, no other function than just to insulate. The tank normally rests on its chassis through rigid brackets or so-called saddles.

In some cases, according to current standards, certain external loads are permitted on the insulation. The thickness of the body can thus be reduced somewhat, if blows and shocks from the outside can be damped by the insulation.

For so-called cryotanks, there is also the possibility, according to the standards, of including an outer shell to take up the load, but these tanks are spherical because of the pressure, so that the only additional purpose of the insulation is to hold the shells apart.

A conventional tank container is therefore both heavy and expensive.

THE INVENTION

A considerably lighter and cheaper construction is achieved according to the invention, according to which an insulated tank container consists of a preferably thin inner shell without any demands on carrying capacity and outside this a semi-hard or hard insulation which has the capacity to take up and transfer stresses in various directions and which is firmly glued to or otherwise integrated with the inner shell.

The inner shell (the container) has an arcuate or purely rectangular cross-section to accommodate as large an amount of liquid as possible. The arcuate shape must be selected for liquids which involve hygiene because the washing apparatus used does not reach into corners.

The container walls are exposed by the liquid to forces which are transferred to the insulation in the form of compressive stresses, shear stresses and sometimes moderate tensile stresses, all of which can be taken up and transferred by the semi-hard or hard insulation.

Thus, together, the inner shell and the insulation form a load-bearing unit. The insulation may have a protective layer on the outside.

Another and preferred embodiment is that a preferably load-bearing outer shell is firmly glued to or otherwise integrated with the insulation, the outer shell preferably comprising protective rigid corner strips.

The insulation may essentially consist of preformed, preferably disc-shaped parts glued to the inner and the outer shell.

The inner shell preferably consists of a preshaped container of a material which is suitable in view of the contents, while the outer shell is built up of rigid corner strips and discs of a material without any demands for resistance to the contents of the container, and the preferably disc-shaped insulating parts are glued to said discs before mounting and are glued to the container during the mounting.

After the mounting of the inner shell, the various disc-shaped insulating parts and the outer shell, certain remaining, unfilled spaces remain between the shells. These can be filled with injected insulating material in foamed form, which hardens in situ.

An alternative method of production is to introduce (inject) foam and harden all the insulating material in situ between preformed shells.

Particularly if the inner shell is very thin and therefore lacks the necessary carrying capacity, there may be some kind of contour-retaining elements in the inner shell during manufacture, which are later removed.

The necessary pipes, valves, etc. are mainly disposed in the insulation so that the tank container has a smooth exterior which is an advantage from several points of view.

BRIEF DESCRIPTION OF THE DRAWINGS

The invention will be described in more detail below with reference to the accompanying drawings in which.

DESCRIPTION OF PREFERRED EMBODIMENTS

Figure 1:
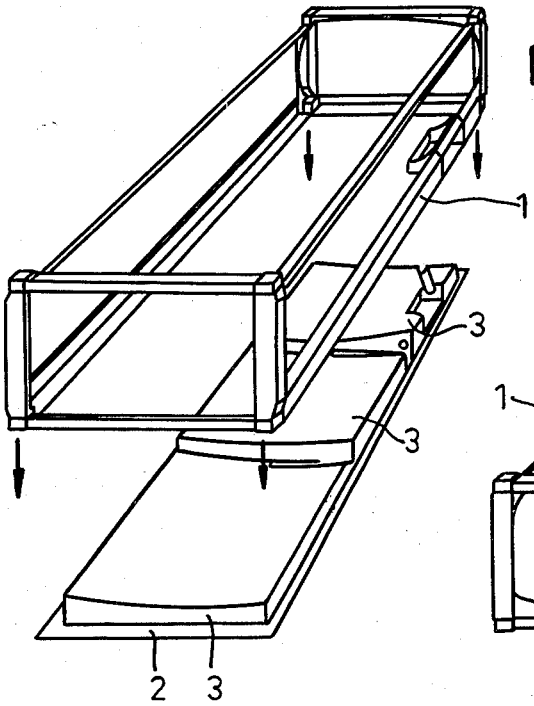
FIGS. 1–3 illustrate typical steps in the coming into existance of a tank container according to the invention and FIGS. 4–6 show, on a smaller scale, three sections through the finished tank container (along the lines IV—IV of FIG. 6, V—V of FIG. 4 and VI—VI of FIG. 5 respectively.

FIG. 1 shows an assembled tank container frame 1, which preferably consists of a plurality of rigid corner strips welded together, for example of aluminium with a typical thickness of 4 mm. Such a frame for a so-called half-high 20' container has a frame weight of about 280 kg.

Figure 6:
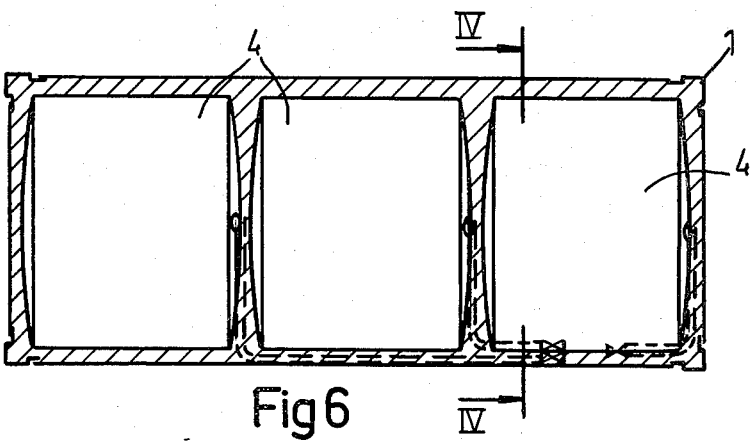

This frame 1 is placed on a bottom covering plate 2, to which there are glued substantially disc-shaped bottom insulating parts 3 with suitable recesses for emptying pipes and valves only indicated in FIG. 6.

These parts 3, like all the insulating parts described below, are made of a semi-hard or hard insulating material with the capacity to take up and transfer stresses in various directions, for example foam plastics of the Divinycell ® type. The bottom covering plate 2, like all the covering plates described below, can be made of aluminium with a thickness of 1.25 mm for example.

Figure 2:
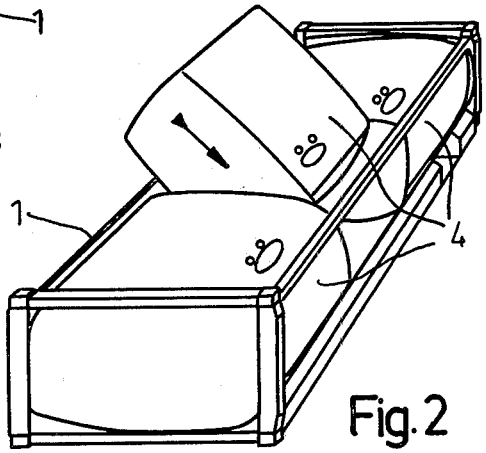

FIG. 2 illustrates the introduction of three inner tanks 4 of a material which is resistant to the intended contents of the tank or which is selected to meet the hygiene demands. On the other hand, in principle, there are no demands on the carrying capacity of the tanks. In the present case, the three tanks are made of stainless plate 1.25 mm thick and then have a total weight of 540 kg.

Figure 3:
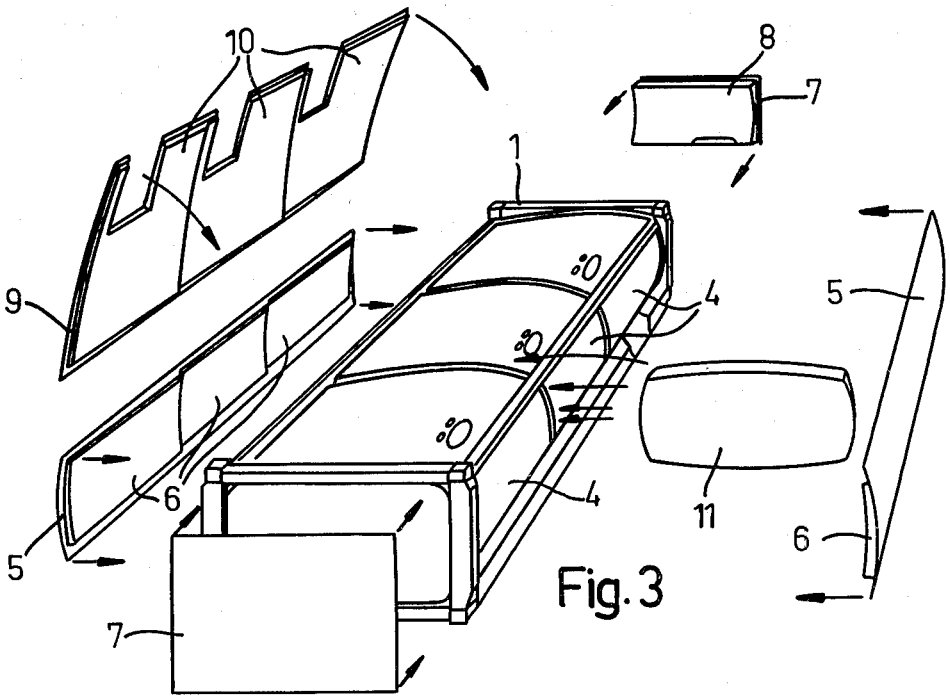

FIG. 3 illustrates the application of the remaining parts to the tank container: side covering plates 5 with glued-on side insulating parts 6, end covering plates 7 with glued-on end insulating parts 8, an upper covering plate 9 with glued-on upper insulating parts 10 and insulating partitions 11 between adjacent tanks.

With the embodiment illustrated and described, the total weight of the covering plates is about 140 kg and of the insulation (Divinycell ® with a density of 60 kg/m$^3$ at the bottom and 45 kg/m$^3$ otherwise) about 160 kg.

The total weight of the tank container shown (including certain other equipment not shown) is about 1200 kg, which may be compared with the weight of 2400 kg for a corresponding conventionally insulated tank container. In both cases the volume of the container is about 14.5 m$^3$.

After suitable adhesive has been supplied to all the surfaces which are to be glued in the construction, that is to say, in principle, all the free surfaces before the assembly described above with reference to FIGS. 1–3, the whole construction may appropriately be placed in a "bag" from which the air is sucked out, while at the same time the interior of the tanks 4 is heated up. As a result vacuum adhesion is brought about.

When the glueing operation is finished, any residual spaces can be filled with injected foam plastics which hardens in situ.

Figure 4:
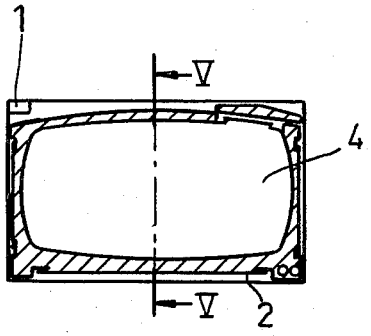
Figure 5:
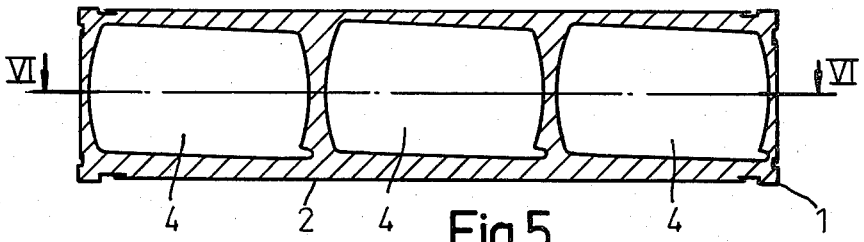

In FIGS. 4–6 the reference numerals for the various insulating parts have been omitted for the sake of clarity; all the hatched surfaces consist of insulation.

It should be observed that the embodiment described is merely an example of various possibilities. In particular, it should be noted that the outer shell and the insulation together as an integrated unit can give the necessary stability and load-bearing capacity. In such a case, the insulation should have some kind of protective outer layer.

Another important modification is that the insulation can be injected, foamed and hardened in situ between preformed shells.

I claim:

1. A light weight insulated tank container system for liquids comprising in combination, a rigid outer framework, a thin inner tank shell comprising a plurality of side by side tanks substantially rectangular in cross-section with outer walls curved outwardly, a foam plastic heat insulation layer outermost shell in contact with the curved surfaces of said outer walls to comprise an outermost surface layer of the container and thereby performing the principal load-bearing surface which has the capacity to take up and transfer stresses in various directions, the foam plastic layer being firmly affixed to and integrated with both the (a) thin inner tank shell to substantially cover the entire surface of the inner tank shell and form together therewith a load bearing unit taking up the forces from the liquid on the thin inner shell and (b) the rigid outer framework to bear the load and dampen blows from external forces, said insulation layer outermost shell being presented as the principal load bearing part over the container system adapted to bear loads.

2. A tank container as claimed in claim 1, characterized in that the framework comprises protective rigid aluminum corner strips.

3. A tank container as claimed in claim 2, characterized in that the foam plastic insulation essentially comprises preformed, disc-shaped parts glued to the inner shell and the rigid framework.

4. A tank container as claimed in any one of claims 1, 2, or 3, wherein the inner shell and rigid framework are affixed together by glue joints.

* * * * *